United States Patent [19]

Steven

[11] 3,936,299

[45] Feb. 3, 1976

[54] METHOD FOR PRODUCING TOOL STEEL ARTICLES

[75] Inventor: Gary Steven, Pittsburgh, Pa.

[73] Assignee: Crucible Inc., Pittsburgh, Pa.

[22] Filed: Sept. 14, 1971

[21] Appl. No.: 180,412

Related U.S. Application Data

[63] Continuation-in-part of Ser. No. 822,672, May 7, 1969, Pat. No. 3,627,514.

[52] U.S. Cl. ..... 75/224; 75/203; 75/204; 75/225; 75/226

[51] Int. Cl.[2] ..... B22F 1/00; B22F 3/00

[58] Field of Search ..... 75/203, 204, 226, 225, 75/224

[56] References Cited

UNITED STATES PATENTS 3,341,325 9/1967 Cloran ..... 75/225

OTHER PUBLICATIONS

Roberts et al., "Tool Steels," 3rd Ed., ASM, 1962, p. 719.

*Primary Examiner*—Leland A. Sebastian
*Assistant Examiner*—B. Hunt

[57] ABSTRACT

This invention relates to a tool steel consisting essentially of, in weight percent, carbon 1 to 1.4 or 2.5, chromium 4 to 6, vanadium 1 to 1.5 or 8, tungsten 7.5 to 13, molybdenum 3.5 to 7, cobalt 9 to 15, nitrogen at least about 0.03 and preferably 0.03 to 0.08, and the balance iron. The invention also relates to a tool steel compact of this steel produced by a powder-metallurgy technique also in accordance with this invention. The tool steel article is characterized by a combination of good cutting performance and machinability.

6 Claims, 4 Drawing Figures

MAGNIFICATION 1000 X

MAGNIFICATION 1000 X

Figure 1A:
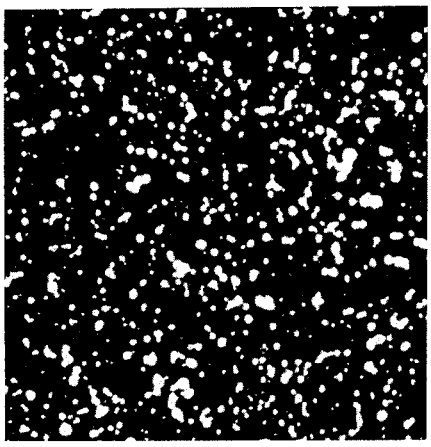

INVENTOR.
GARY STEVEN

Clair L. Mullen Jr.
Attorney

INVENTOR.
GARY STEVEN
By Claire L. Mullen Jr.
Attorney

INVENTOR.
GARY STEVEN
By Clair L. Mullen Jr.
Attorney

METHOD FOR PRODUCING TOOL STEEL ARTICLES

This application is a continuation-in-part of copending application Ser. No. 822,672, filed May 7, 1969 now U.S. Pat. No. 3,627,514.

For all tool steel articles for cutting applications, it is desired to have a combination of machinability and good cutting performance. This is a somewhat difficult combination to achieve in that for good cutting performance the alloy from which the tool steel article is made must be characterized by high hardness. On the other hand, the harder the material, the more difficult it will be to machine. In addition, and more specifically, this desired combination of properties is affected by the carbide size and distribution within the steel. A fine, even dispersion of adequate carbides will provide the required hardness and thus tool life. However, to achieve substantial carbide formation it is necessary to employ high austenitizing temperatures, on the order of 2200°F, so that the carbide formers present in the alloy go into solution and are thus available to precipitate as carbides upon tempering. The higher the austenitizing temperature, the greater will be the amount of carbide formers in solution, and thus the amount of carbides formed upon tempering. It is known, however, that the use of high austenitizing temperatures results in grain coarsening of the alloy and excessive carbide growth and agglomeration. Grain coarsening and excessive coarsening of carbides, as is well known, impair cutting performance of tool steel articles.

It is accordingly the primary object of this invention to provide a tool steel that overcomes the above-described disadvantages in that it is characterized by a good combination of machinability and cutting performance.

A more specific object of the invention is to provide a tool steel that may be austenitized at the high temperature required to take the carbide formers present in the material into solution, without causing attendant grain coarsening.

Another more specific object of the invention is to provide a tool steel alloy wherein a good combination of machinability and cutting performance is achieved by a critical combination of a controlled nitrogen content in combination with specific carbide formers wherein a fine, uniform carbide distribution is maintained even in the presence of high austenitizing temperatures.

Another related object of the invention is to provide a tool steel compact produced in accordance with a powder metallurgy process that results in said article having a desired combination of good machinability and cutting performance resulting from the presence of a fine, uniform carbide distribution throughout the compact.

Figure 1B:
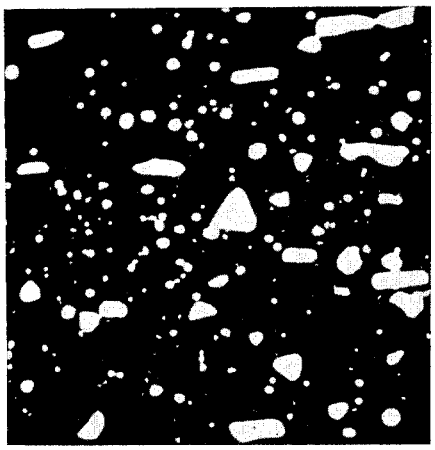
Figure 2A:
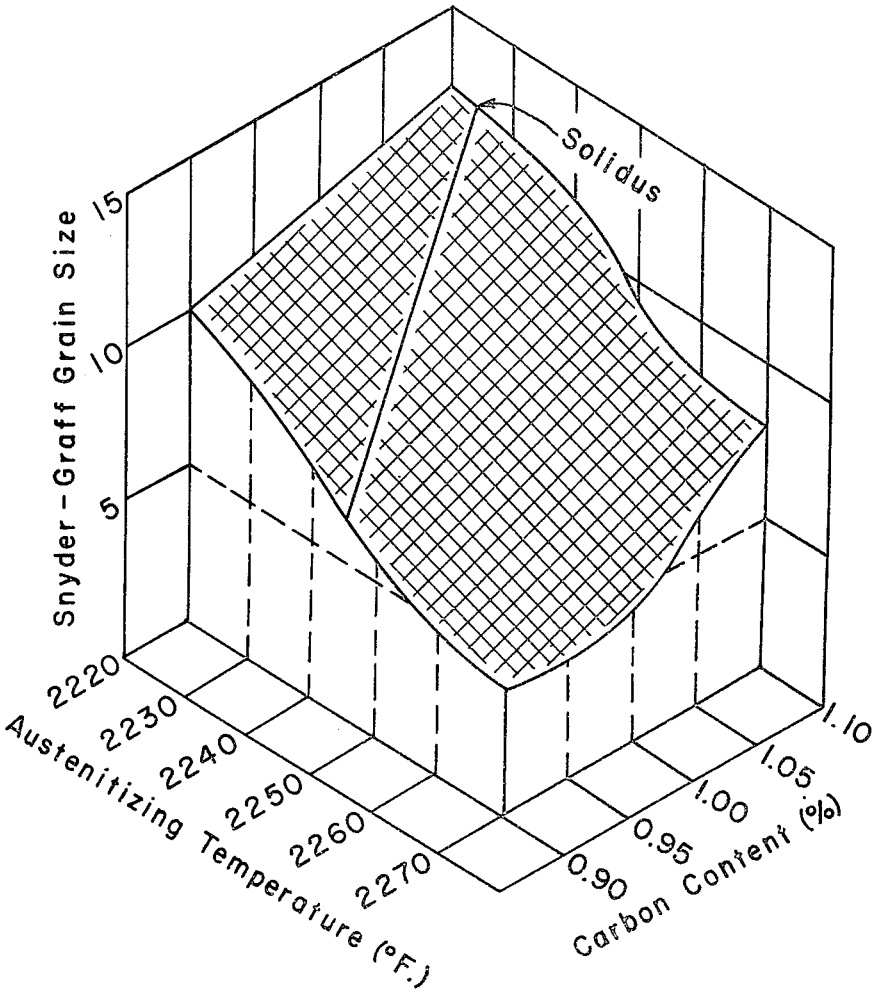
Figure 2B:
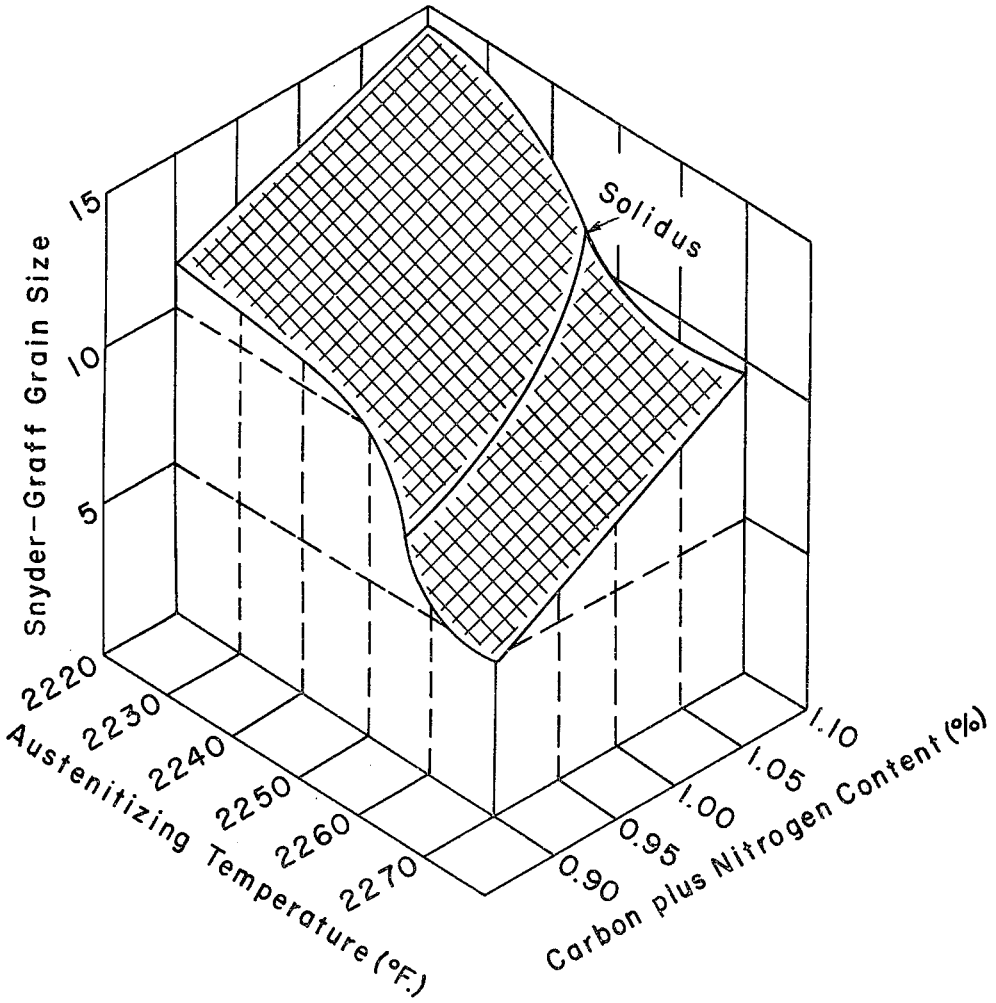

These and other objects of the invention, as well as the complete understanding thereof, may be obtained from the following description and drawings, in which:

FIGS. 1A and 1B are photomicrographs of a steel in accordance with the present invention and a conventional tool steel, respectively, wherein the effect of the invention is shown in respect to the carbide form, size and distribution; and FIGS. 2A and 2B are three-dimensional plots of grain size vs. austenitizing temperature and carbon content, and grain size vs. austenitizing temperature and carbon plus nitrogen content, respectively.

The tool steel of the invention consists essentially of, in weight percent, carbon 1 to 1.4 or 2.5, chromium 4 to 6, vanadium 1 to 1.5 or 8, tungsten 7.5 to 13, molybdenum 3.5 to 7, cobalt 9 to 15, nitrogen at least about 0.03 and preferably 0.03 to 0.08, and the balance iron. In accordance with the invention, this steel is used in the form of a powder of about −8 mesh U.S. Standard. This powder is placed in a metal container, which is gas tight. The container is heated to an elevated temperature in excess of about 2000°F and its interior is pumped to a low pressure whereupon the gaseous reaction products and principally those resulting from the reaction of carbon and oxygen are removed. Upon removal of the gaseous reaction products and while the container is at low pressure and elevated temperature it is sealed against the atmosphere, and transferred to a compacting apparatus. Compacting may be by mechanical apparatus wherein the container is placed in a die and a ram is inserted to compact the container and charge. Alternately, the container may be placed in a fluid-pressure vessel, commonly termed an autoclave, where a fluid pressurizing medium, and as helium gas, may be employed to provide the desired compacting. In any event, however, compacting is completed prior to the charge cooling below a temperature of about 1900°F, and during the operation a compacted density greater than about 95% is achieved. After compacting, conventional forming and machining operations are performed on the compact, during which a density of 100% is achieved, to produce the desired final tool steel product. To achieve the required nitrogen content in the alloy, in accordance with the present invention, such may be either included in the melt or, alternately, nitrogen in gaseous form may be introduced to the container, as above described, after outgassing and prior to compacting. In this manner, the charge of powdered metal in the container will be nitrided to the desired nitrogen level in accordance with the invention.

The carbon content of the alloy, as above disclosed, must be properly balanced against the carbide-forming elements, such as vanadium, tungsten and molybdenum, to produce the carbide precipitation upon cooling from austenitizing temperature required to prevent softening during subsequent annealing. Of the carbide formers, vanadium functions to produce carbides that have been found to be wear-resistant and thus contribute greatly to the tool life of articles made from the alloy. However, if too much vanadium is used these wear-resistant carbides make the steel difficult to machine the grind. Tungsten, on the other hand, provides carbides that retain hardness at high temperature, principally because they do not appreciably or substantially grow and agglomerate at high austenitizing temperatures and, therefore, grain coarsening of the alloy is retarded. Molybdenum acts in the same manner as tungsten with respect to carbide formation, except that tungsten is critical for the purposes of preventing grain coarsening, which result cannot be achieved by the use of molybdenum alone. Specifically, in the processing of the steel it is austenitized at a high temperature on the order of 2200°F and then hardened during cooling. The austenitizing step involves heating to dissolve the carbide-forming elements. After quenching from austenitizing temperature, the material is subjected to reheating at a lower temperature at which the carbide-forming elements are precipitated in the form of carbides. This, of course, produces the desired secondary hardening. During austenitizing, the carbon is dissolved in the austenite, which upon cooling transforms to a required hard carbon-containing martensite. The carbide-forming elements remain in solution in the martensite. Subsequently, however, the carbide-forming elements during tempering combine with the carbon in the steel and form carbides. This carbide precipitation results in the desired secondary hardening. The cobalt present in the alloy contributes to the retention of hardness at high temperatures. As above described, the presence of nitrogen in an amount of at least 0.03%, and preferably within the range of 0.03 to 0.08%, is necessary to achieve a fine carbide distribution. This result of nitrogen has been found not to increase significantly at nitrogen levels substantially above 0.08%. It should be noted that the maximum amount of nitrogen present in the alloy is limited by the solubility of nitrogen in the melt, unless the nitrogen is added by gaseous diffusion as above described. The principal role of chromium in the alloy is to delay the precipitation of carbides upon tempering to contribute to the high-temperature hardness.

It may be seen, therefore, that the combination of nitrogen and tungsten is critical for the purpose of preventing carbide growth and agglomeration and hance grain coarsening; whereas, vanadium provides the wear-resistance carbides necessary for good tool life.

To demonstrate the present invention samples of the steels with the compositions listed in Table I were produced. In addition to the Rex 71 P/M steels listed in Table I, two additional compacts with similar compositions except for having nitrogen contents of 0.003 and 0.017% were prepared.

TABLE I

| Steel | AISI Type | COMPOSITION[a] Chemical Composition, Percent C | Cr | W | Mo | V | Co | N |
|---|---|---|---|---|---|---|---|---|
| Rex 71 P/M | — | 1.20 | 4.00 | 10.0 | 5.00 | 1.15 | 12.00 | 0.03 |
| | | 1.25 | 4.50 | 10.5 | 5.50 | 1.40 | 12.50 | 0.08 |
| Rex 49 | M41 | 1.10 | 4.25 | 6.75 | 3.75 | 2.00 | 5.0 | — |
| Rex M42 | M42 | 1.10 | 3.75 | 1.5 | 9.5 | 1.15 | 8.0 | — |
| Maxicort (German Norm S 10-4-3-10) | — | 1.25 | 4.25 | 10.5 | 3.75 | 3.25 | 10.5 | — |

[a]All steels contain nominally 0.3% Mn, 0.3% Si, 0.025% S max. and 0.025% P max.

The Rex 71 P/M materials were made from particles of the alloy of a mesh size of −50 + 325 U.S. Standard. A charge of these particles was placed into a mild steel cylinder about 4 in. long and having a 3¾ in. diameter. This container, which was gas tight, was heated to a temperature of 2100°F for about 4 hours at which time the container interior was connected to a pump which was used to remove the gaseous reaction products from the container. The container, at a temperature of about 200°F, was placed in a die and a ram of a 200-ton press was used to compact the container and charge to a density greater than 95%. After compacting, the material was forged into ¾ in. square bars, during which operation a density of essentially 100% was achieved. The other steels, as reported in Table I, were conventionally cast and wrought from 50-pound, air-induction heats. Specifically, they were cast into 4 × 4 × 10 in. ingots and forged to ¾ in. bars as were the above samples produced by the described powder metallurgy technique. All of the steels reported in Table I were austenitized at a temperature of about 2200°F for 4 minutes and oil quenched. The steels of Table I were tested for machinability by the conventional Drill Machinability Test. In this test ¼ in. drills were used to drill holes 0.250 in. deep while operating at 460 rpm using a constant thrust at the quill of 150 pounds.

TABLE II

| Steel | Hardness $R_c$ (Annealed (Stock) | MACHINABILITY Average Time (Sec.) Required to Drill Four ¼-in. Holes Drill No. 1 | Drill No. 2 | Drill No. 3 | Drill No. 4 | Drill No. 5 | Drill No. 6 | Machinability Index[a] M.I.% |
|---|---|---|---|---|---|---|---|---|
| Rex 49 | 21 | 29.6 | 26.8 | 25.4 | 25.4 | 27.0 | 23.3 | 100 |
| Rex M42 | 21.5 | 26.6 | 23.6 | 21.7 | — | — | — | 114 |
| Rex 71 P/M | 26 | 23.0 | 23.7 | 20.9 | 20.3 | 20.8 | 18.7 | 124 |

$$^{(a)}\text{M.I.} = \frac{\text{Average time to drill standard (Rex 49)}}{\text{Average time to drill test material}} \times 100$$

As may be seen from the results present in Table II, the Rex 71 P/M sample while having a hardness of 26 $R_c$ was 24% easier to machine than, for example, the annealed commercial Rex 49, which had a hardness of 21 $R_c$. All the samples as reported in Table II, were subjected to an annealing cycle of 1350°F for a period of about 12 hours. The results presented in Table II show an unexpectedly improved machinability in spite of the significantly higher hardness of the Rex 71 P/M sample.

The superiority of the steels of the invention as shown in Table I over the conventional steels also shown in that Table is further demonstrated by the comparative Continuous-Cut Lathe Turning Test results reported in Table III.

TABLE III

| Cutting Tool | Hardness $R_c$ | CONTINUOUS-CUT LATHE TURNING[a] Average Tool Life[b] in Minutes at Indicated Cutting Speed 32 sfpm | 35 sfpm | 40 sfpm |
|---|---|---|---|---|
| Workpiece: AISI H13 Die Steel at 53 $R_c$ | | | | |
| Rex 49 | 67.5 | 10.0 | 2.8 | 1.3 |
| Rex M42 | 67.5 | 19.1 | 6.2 | |
| Maxicort | 67.5 | 20.0 | 5.1 | |
| Rex 71 P/M | 70.0 | 40.3 | 16.0 | 4.5 |
| Workpiece: C-125 AVT Titanium (140,000 psi Tensile Strength) | | | | |

TABLE III-continued

| CONTINUOUS-CUT LATHE TURNING[a] | | | | |
|---|---|---|---|---|
| Cutting Tool | Hardness $R_c$ | Average Tool Life[b] in Minutes at Indicated Cutting Speed 32 sfpm | 35 sfpm | 40 sfpm |
| Rex 49 | 67.5 | — | 22.7 | 3.7 |
| Rex M42 | 67.5 | — | 53.8 | — |
| Rex 71 P/M | 70.0 | — | 86.0 | 13.0 |

[a]Feed 0.010 in./rev.; depth-of-cut 0.062 in.; cutting oil: none tool geometry: 3°, 6°, 10°, 10°, 10°, 10° 0.030-in. nose radius
[b]Complete Tool Nose Failure It may be seen from the test results of Table III that the average tool life of the Rex 71 P/M lathe cutting tools is four times that of Rex 49 (M41) during use in the test to continuously turn the reported difficult-to-machine alloys at identical speed, feed, and depth-of-cut. Specifically, as shown in Table III, the Rex 71 P/M cutting tools averaged 16 minutes before failure in cutting at 35 sfpm a workpiece of AISI H13 die steel having a hardness of 53 $R_c$; whereas, the best performance of tools made from conventional high-performance high-speed steels was an average of 2.8 minutes for M41 and 6.2 minutes for M42 cutting tools used to cut the same workpiece. A cutting tool of the steel of the invention also showed superior performance when compared with cutting tools of conventional tool steels in cutting a workpiece of C-125 AVT titanium. In this application, as shown in Table III, the Rex 71 P/M cutting tool of the invention averaged 86 minutes before failure; whereas, the cutting tools made from M42 and M41 averaged 53.8 minutes and 22.7 minutes, respectively, before failure.

TABLE IV

| CHEMICAL COMPOSITION OF EXPERIMENTAL STEELS | | | | | | | | | | | |
|---|---|---|---|---|---|---|---|---|---|---|---|
| | Composition, Weight Percent | | | | | | | | | | |
| Steel | C | N | Mn | S | P | Si | Cr | V | W | Mo | Co |
| | | | | Molybdenum High-Speed Steels | | | | | | | |
| A | 0.86 | 0.01 | 0.37 | 0.019 | 0.010 | 0.35 | 3.87 | 1.75 | 1.85 | 8.74 | — |
| B | 0.85 | 0.06 | 0.30 | 0.018 | 0.015 | 0.29 | 3.74 | 2.11 | 1.80 | 8.74 | — |
| C | 1.00 | <0.01 | 0.31 | 0.13 | 0.014 | 0.30 | 4.00 | 2.13 | 1.66 | 8.45 | — |
| D | 0.91 | 0.08 | 0.35 | 0.13 | 0.016 | 0.28 | 3.95 | 2.29 | 1.66 | 8.95 | — |
| E | 1.09 | <0.01 | 0.25 | 0.020 | 0.020 | 0.27 | 3.75 | 2.05 | 1.75 | 8.86 | — |
| F | 0.98 | 0.08 | 0.24 | 0.020 | 0.020 | 0.35 | 3.75 | 2.05 | 1.75 | 8.75 | — |
| G | 0.94 | <0.01 | 0.54 | 0.020 | 0.020 | 0.25 | 3.75 | 2.05 | 1.75 | 8.68 | — |

To demonstrate the criticality of nitrogen within the ranges of the present invention in controlling carbide form, size, and distribution, steels of the compositions reported in Table IV were produced. In these steels the tungsten content, in particular, was maintained at a low level so that its effect with regard to grain refinement could be substantially discounted.

All the steels reported in Table IV were melted as 50-pound induction heats, teemed into 4-inch square ingot molds and hot forged to ¾-inch square bars. The melting charges of Steels A, C, E and G contained high-purity electrolytic chromium to limit the nitrogen content to 0.01% or less. Melting and teeming were carried out under a protected argon blanket to prevent nitrogen absorption from the atmosphere. The highnitrogen Steels B, D and F were melted with ferrochromium-containing nitrogen. Before heat-treating, all the steels of Table IV were spheroidize annealed at 1600°F for 2 hours, cooled to 1400°F, held for 4 hours, and then air-cooled to room temperature. Laboratory size specimens cut from these bar samples were austenitized at 10° intervals between 2200°F and 2270°F and thereafter oil quenched. The grain-coarsening characteristics of the as-quenched microstructures were determined.

A metallographic examination of the samples, which were austenitized at temperatures between 2200°F and 2270°F, showed that the high nitrogen Steels B, D, and F retained a fine grain structure in the presence of higher temperatures than did the nitrogen-free Steels A, c, E, and G with an equivalent interstitial alloy content. This comparison between the highnitrogen steels and the nitrogen-free steels is shown in FIGS. 2A and 2B. In both of these Figures a three-dimensional plot of grain size vs. austenitizing temperature and total interstitial content is presented. In FIG. 2A the total interstitial content consists of carbon; whereas, with FIG. 2B the interstitial content consists of carbon plus nitrogen. The range of total interstitial content is from 0.85 to 1.10%. It may be seen from the results presented in this Figure that although grain size increases both with and without nitrogen in the presence of increased austenitizing temperatures, a nitrogen addition, within the scope of the present invention, drastically depresses this grain-coarsening effect. For example, with the total interstitial content being equal in the absence of nitrogen an austenitizing temperature of 2240°F results in a grain size of 9 Snyder-Graff; whereas, in the presence of nitrogen an austenitizing temperature of 2240°F results in a grain size of 13 Snyder-Graff.

I claim:

1. A method for producing a tool steel article characterized by fine, globular, evenly dispersed carbides, and a combination of good cutting performance and machinability comprising compacting a powdered alloy charge of the following composition, in weight percent:

| | |
|---|---|
| Carbon | 1 to 2.5 |
| Chromium | 4 to 6 |
| Vanadium | 1 to 8 |
| Tungsten | 7.5 to 13 |
| Molybdenum | 3.5 to 7 |
| Cobalt | 9 to 15 |
| Nitrogen | At least about .03 |
| Iron | Balance |

said compacting being conducted after heating said charge and with said charge at elevated temperature to produce a compact of a density greater than about 95%.

2. The method of claim 1 wherein said alloy has a nitrogen content of about 0.03 to 0.08%.

3. The method of claim 1 wherein prior to compacting said powdered alloy charge is placed in a gas-tight container, said container and charge are heated to an elevated temperature in excess of about 2000°F, the container is pumped to remove gaseous reaction products resulting from said heating and said compacting is completed prior to cooling of said charge below about

1900°F.

4. The method of claim 3 wherein, after removal of said gaseous reaction products and prior to compacting, nitrogen in gaseous form is introduced to said container to provide said nitrogen content of at least about 0.03%.

5. The method of claim 1 wherein said alloy has a vanadium content of 1 to 1.5% and a carbon content of 1 to 2.5%.

6. A method for producing a tool steel article characterized by fine, globular, evenly dispersed carbides, and a combination of good cutting performance and machinability comprising placing in a gas-tight container a powdered metal charge of the following composition, in weight percent:

| | |
|---|---|
| Carbon | 1 to 1.4 |
| Chromium | 4 to 6 |
| Vanadium | 1 to 1.5 |
| Tungsten | 7.5 to 13 |
| Molybdenum | 3.5 to 7 |
| Cobalt | 9 to 15 |
| Nitrogen | .03 to .08 |
| Iron | Balance |

heating said container and charge to an elevated temperature in excess of about 2000°F, removing from said container gaseous reaction products resulting from said heating and compacting said charge to a density greater than about 95% prior to said charge cooling below a temperature of about 1900°F.

* * * * *

UNITED STATES PATENT OFFICE

CERTIFICATE OF CORRECTION

Patent No. 3,936,299 Dated February 3, 1976

Inventor(s) Gary Steven

It is certified that error appears in the above-identified patent and that said Letters Patent are hereby corrected as shown below:

Column 4, line 1, "200°F" should be --2000°F--;

TABLE II, footnote "(a)" should read $$--^{(a)}\text{M.I.} = \frac{\text{Average time to drill standard (Rex 49)}}{\text{Average time to drill test material}} \times 100--;$$

Column 6, line 8, after "A,", change "c" to --C--;

Signed and Sealed this

Sixth Day of July 1976

[SEAL]

*Attest:*

RUTH C. MASON
*Attesting Officer*

C. MARSHALL DANN
*Commissioner of Patents and Trademarks*